United States Patent [19]

Gizard et al.

[11] 3,974,930

[45] Aug. 17, 1976

[54] STOPPER FOR SPECIMEN CONTAINER

[75] Inventors: Pierre Gizard, Eybens; Jean Boyer, Echirolles, both of France

[73] Assignee: Becton, Dickinson and Company, East Rutherford, N.J.

[22] Filed: Apr. 9, 1975

[21] Appl. No.: 566,360

[52] U.S. Cl. ..... 215/247; 215/DIG. 3

[51] Int. Cl.[2] ..... B65D 47/36

[58] Field of Search ..... 215/247–249, 215/DIG. 3, 355

[56] References Cited

UNITED STATES PATENTS

| | | | |
|---|---|---|---|
| 2,334,905 | 11/1943 | Cherkin | 215/DIG. 3 |
| 3,106,206 | 10/1963 | Barr, Sr. et al. | 215/247 X |
| 3,313,439 | 4/1967 | Robinson | 215/247 |
| 3,330,282 | 7/1967 | Visser et al. | 215/247 X |
| 3,460,702 | 8/1969 | Andrews | 215/247 |
| 3,653,528 | 4/1972 | Wimmer | 215/247 |

*Primary Examiner*—George E. Lowrance
*Assistant Examiner*—Stephen Marcus
*Attorney, Agent, or Firm*—Kane, Dalsimer, Kane, Sullivan and Kurucz

[57] ABSTRACT

A stopper which is particularly adaptable to be mounted in an evacuated tube, for example, of the type employed in fluid collection procedures such as the sampling of blood under vacuum. The stopper is designed with a central shaft and a membrane located intermediate the ends of the central shaft. A part of the shaft above the membrane is narrowed upwardly to facilitate retention of a drop of fluid such as blood displaced from the tip of a needle as it is removed from the stopper after the collection procedure.

4 Claims, 2 Drawing Figures

STOPPER FOR SPECIMEN CONTAINER

BACKGROUND OF THE INVENTION

The present invention relates to stoppers, in particular for use with liquid specimen tubes. More particularly, it is applicable to tubes for sampling of blood under vacuum.

To collect blood for the purpose of analysis, a flexible tube including a needle at each end may be used. One of the needles is inserted into the vein, while the other serves for the perforation of the stopper of the tube under vacuum. Experience proves that the withdrawal of the needle leaves traces of blood on the head of the stopper, which entails a risk of contamination of personnel involved with handling of the tube containing the stopper.

SUMMARY OF THE INVENTION

With the above background in mind, it is an object of this invention to overcome the risk of contamination drawback by use of a stopper comprising a body surmounted by a head containing a central shaft closed by a membrane. A part of the shaft located above the membrane narrows upwardly.

The drop of blood at the end of the needle is retained between the membrane and the neck or constriction. The closer the constriction is to the membrane and the further the neck is from the upper opening of the shaft, the less possible it is for the blood to come in contact with the personnel handling the stopper and tube.

For considerations of symmetry, the part which narrows is advantageously frustoconic. It retains the drop particularly well when the angle of the top of the frustum is greater than 10° and better than 15°.

Since the frustum for retaining the drop has its small base or neck upward, the insertion of the needle into the opening could involve difficulty. Thus, this convergent narrowing part may be extended by a part which diverges outwardly towards the head. This ensures easier positioning and guidance of the needle. Advantageously, the divergent part is adjacent the part which narrows, and it takes the form of a frustum of a cone whose angle at the top is less than 30° and preferently than 20°.

To obtain an angle of this size, without giving the stopper too great a height within the consumption of material which results therefrom, and without having an upper opening of the shaft of dimensions too small for the pre-insertion of the needle, it is advisable that the divergent part be extended by a section opening outwardly and still more divergent than said divergent part.

With the above objectives, among others, in mind reference is had to the attached drawings.

BRIEF DESCRIPTION OF THE DRAWING

In the accompanying drawing, given solely by way of example.

DESCRIPTION OF THE PREFERRED EMBODIMENT

Figure 1:
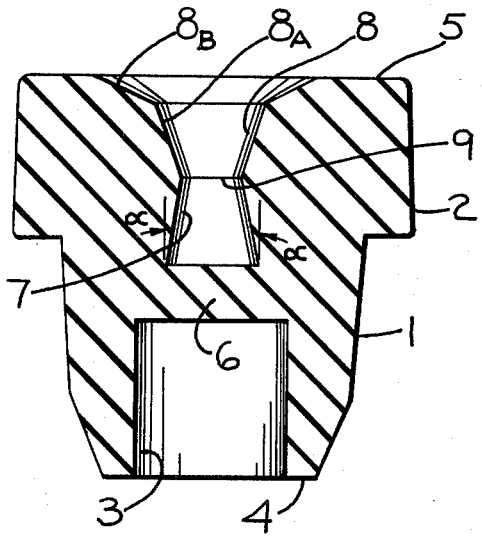
FIG. 1 is a sectional view through a diametric plane of a stopper according to the invention.
Figure 2:
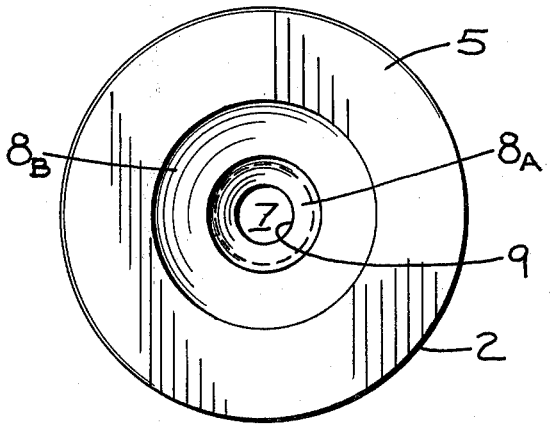
FIG. 2 is a plan view thereof.

The stopper shown is made of butyl rubber or other flexible and fluid type material commonly employed with a conventional sample connection tube so as to be inserted therein and hold a vacuum within the tube.

The stopper includes a body 1 surmounted by a coaxial head 2 of greater diameter. The body 1 is adapted to be engaged with fluid tightness in a tube. A shaft 3 extends from the bottom 4 of the body 1 to the top 5 of the head 2. It is closed by a membrane 6 which is located below the head 2 so as to leave the stopper structure constituted by the body 1 intact, while enabling easier perforation than is conventional in view of its thinness which, for example, is between 1.5 and 2.5 mm.

Above the membrane 6, inside the head 2, the shaft is of a convergent-divergent shape and has at least two portions. The lower portion 7 has its lower end connected to the membrane 6 and narrows upwardly. The apex angle alpha of the cone formed by first shaft portion 7 is about 15°. The lower shaft portion 7 is extended by a divergent second shaft portion 8 constituted by two portions 8A and 8B. The lower end of shaft portion 8 is directly connected to the upper end of first shaft portion 7, forming an area of constriction. The neck or area constriction 9 between the parts 7 and 8 is at a distance from the top 5 and has a cross section greater than that of the needle.

When a needle has to be inserted through the opening of the top 5 of the head 1, the portion 8B ensures pre-guidance, although no considerable force is exerted on the needle, so that the latter enters the portion 8A, and perforates the membrane 6.

Portion 8B in effect constitutes a third portion of the shaft above membrane 6. When the needle is withdrawn, the drop of blood at its end is arrested by the neck 9 of the convergent-divergent portion and remains imprisoned in the shaft. The neck has a diameter from 2 to 6 mm. and for example from 3 to 5 mm. In the depicted embodiment, the neck has a diameter of 4 mm.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. A stopper comprising; a body surmounted by a head, a central shaft closed by a membrane, said shaft having at least two portions, each of said shaft portions having an upper end and a lower end, the first portion of said shaft extending upwardly and narrowing inwardly from said membrane, the second portion of said shaft being directly connected at its lower end to the upper end of said first portion and diverging outwardly from the upper end of said first portion so as to provide a constriction at the area at which said first and second shaft portions are directly connected.

2. The invention in accordance with claim 1 wherein the first and second portions are fustroconical in configuration and taper inwardly toward their point of communication.

3. The invention in accordance with claim 1 wherein the angle with respect to the vertical at the upper end of the first portion is greater than 10° and the angle with respect to the vertical at the upper end of the second portion is less than 30°.

4. The invention in accordance with claim 1 wherein said central shaft has a third portion, said third portion extending upwardly and outwardly from the upper end of the second portion to the upper end of the head.

* * * * *